US011303069B2

(12) United States Patent
Zhang et al.

(10) Patent No.: US 11,303,069 B2
(45) Date of Patent: Apr. 12, 2022

(54) ELECTRICAL CONNECTOR WITH CAPACITIVE AND RESISTIVE CHARACTERISTICS TO SATISFY REQUIRED MATCHING IMPEDANCE

(71) Applicant: LOTES CO., LTD, Keelung (TW)

(72) Inventors: Biao Zhang, Keelung (TW); Jia Xu Yin, Keelung (TW); Chong Cheng Liang, Keelung (TW); Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/077,442

(22) Filed: Oct. 22, 2020

(65) Prior Publication Data

US 2021/0126403 A1 Apr. 29, 2021

(30) Foreign Application Priority Data

Oct. 25, 2019 (CN) ..... 201911024561.4

(51) Int. Cl.
*H01R 13/6477* (2011.01)
*H01R 12/73* (2011.01)
(Continued)

(52) U.S. Cl.
CPC ..... *H01R 13/6477* (2013.01); *H01R 12/737* (2013.01); *H01R 13/11* (2013.01);
(Continued)

(58) Field of Classification Search
CPC .. H01R 13/6477; H01R 13/11; H01R 13/502; H01R 13/6581; H01R 13/6597; H01R 13/64; H01R 12/737
(Continued)

(56) References Cited

U.S. PATENT DOCUMENTS 3,710,303 A * 1/1973 Gallager, Jr. ..... H01R 12/87 439/593
4,077,688 A * 3/1978 Cobaugh ..... H01R 12/88 439/267
(Continued)

FOREIGN PATENT DOCUMENTS

CN 200990423 Y 12/2007
CN 208461040 U 2/2019
(Continued)

*Primary Examiner* — Peter G Leigh
(74) *Attorney, Agent, or Firm* — Locke Lord LLP; Tim Tingkang Xia, Esq.

(57) ABSTRACT

An electrical connector includes: a first main body, having a first wall surface and a second wall surface; a second main body, mounted on the first main body, and having a third wall surface and a fourth wall surface. A first channel is formed between the first wall surface and the third wall surface. A second channel is formed between the second wall surface and the fourth wall surface and is communicated with the first channel. A signal terminal has a fixing portion accommodated in the first channel and fixed by at least one of the first main body and the second main body, and an elastic arm formed by extending from the fixing portion and accommodated in the second channel. A contact portion is provided on the elastic arm and is exposed to the first main body in a left-right direction to be in contact with the mating member.

20 Claims, 16 Drawing Sheets

(51) Int. Cl.

| | |
|---|---|
| ***H01R 13/11*** | (2006.01) |
| ***H01R 13/502*** | (2006.01) |
| ***H01R 13/6581*** | (2011.01) |
| ***H01R 13/6597*** | (2011.01) |
| *H01R 13/64* | (2006.01) |

(52) U.S. Cl.
CPC ..... *H01R 13/502* (2013.01); *H01R 13/6581* (2013.01); *H01R 13/6597* (2013.01); *H01R 13/64* (2013.01)

(58) Field of Classification Search
USPC ..... 439/607.32
See application file for complete search history.

(56) References Cited

U.S. PATENT DOCUMENTS

| | | | | |
|---|---|---|---|---|
| 5,094,623 | A | 3/1992 | Scharf et al. | |
| 6,019,616 | A * | 2/2000 | Yagi | H01R 13/6582 439/108 |
| 6,213,804 | B1 * | 4/2001 | Matsumura | H01R 12/87 439/267 |
| 6,447,317 | B1 * | 9/2002 | Billman | H01R 13/6582 439/260 |
| 6,979,216 | B2 * | 12/2005 | Maeda | H01R 12/88 439/260 |
| 7,048,585 | B2 * | 5/2006 | Milbrand, Jr. | H01R 12/00 439/607.09 |
| 7,294,019 | B1 * | 11/2007 | Jeon | H01R 13/6658 439/108 |
| 7,497,713 | B1 * | 3/2009 | Huettner | H01R 27/00 439/265 |
| 8,449,335 | B2 * | 5/2013 | Briant | H01R 12/7005 439/637 |
| 8,579,662 | B2 * | 11/2013 | Briant | H01R 12/716 439/607.08 |
| 9,048,581 | B2 * | 6/2015 | Briant | H01R 13/4361 |
| 9,065,225 | B2 | 6/2015 | Degner et al. | |
| 9,520,678 | B2 * | 12/2016 | Su | H01R 13/6477 |
| 10,116,079 | B1 * | 10/2018 | Ju | H01R 12/7076 |
| 10,454,203 | B2 * | 10/2019 | Phillips | H01R 12/721 |
| 2012/0064743 | A1 * | 3/2012 | Qin | H01R 13/6471 439/92 |
| 2019/0052019 | A1 * | 2/2019 | Huang | H01R 13/6476 |
| 2019/0190212 | A1 * | 6/2019 | Fang | H01R 13/646 |

FOREIGN PATENT DOCUMENTS

| | | | |
|---|---|---|---|
| CN | 208539156 | U | 2/2019 |
| CN | 108448287 | B | 1/2020 |
| CN | 107017526 | B | 2/2020 |

* cited by examiner 4
4
Y
X
41
3
41
2b 2a 2a 2b 2a 2b 2a 2b

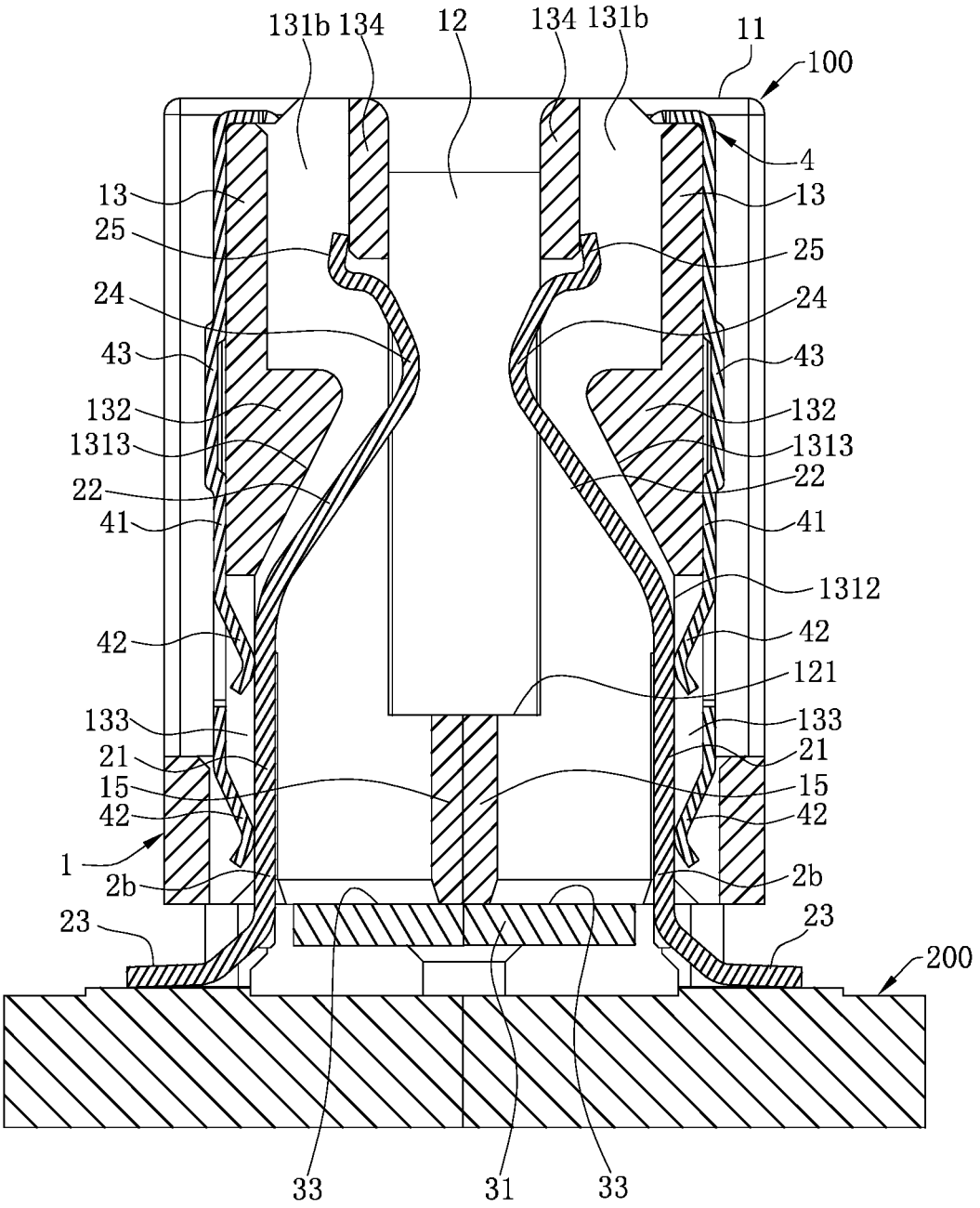
C-C
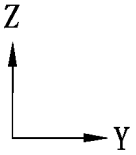
FIG. 10

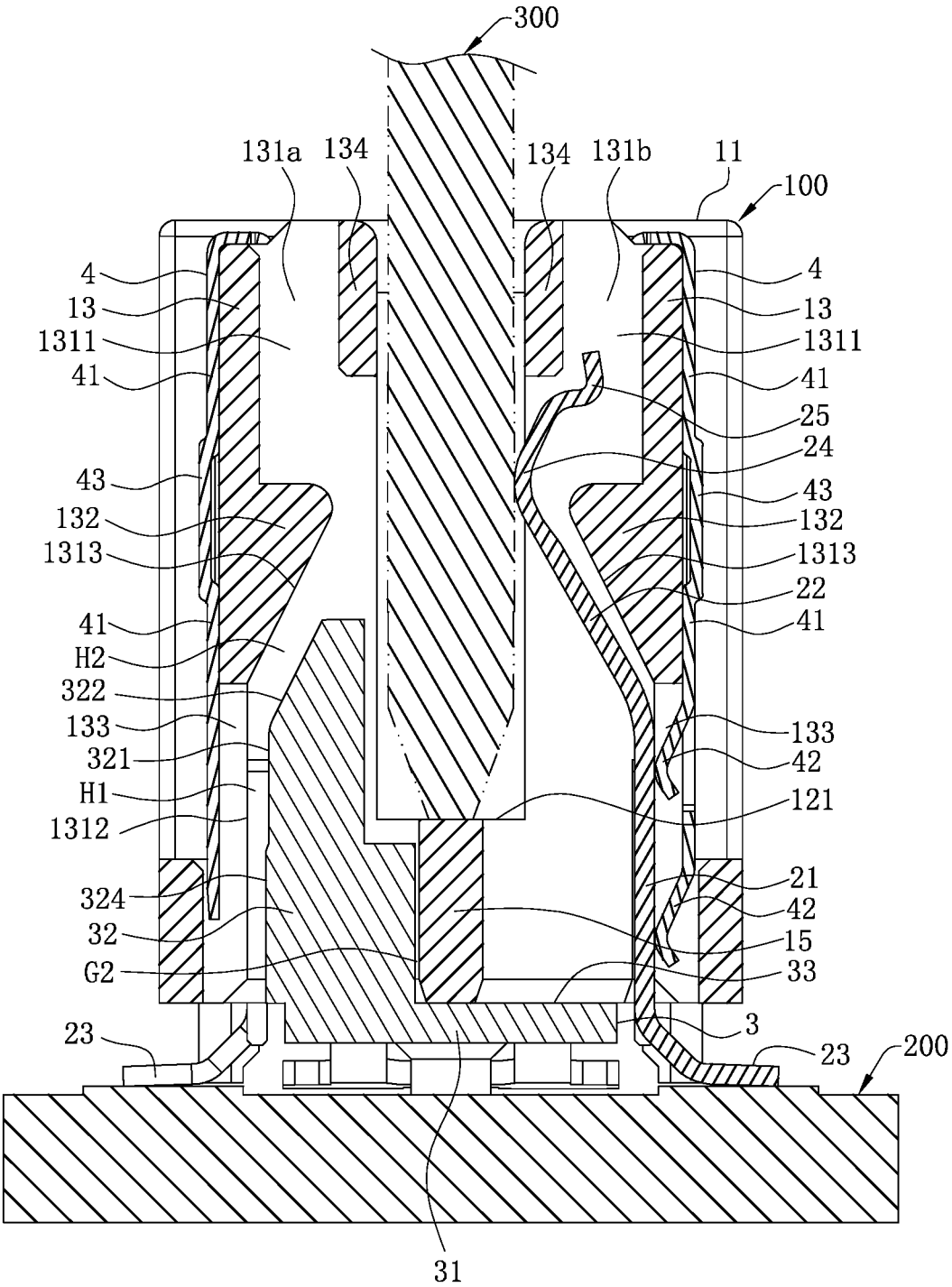
D-D
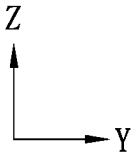
FIG. 11

ELECTRICAL CONNECTOR WITH CAPACITIVE AND RESISTIVE CHARACTERISTICS TO SATISFY REQUIRED MATCHING IMPEDANCE

CROSS-REFERENCE TO RELATED PATENT APPLICATION

This non-provisional application claims priority to and the benefit of, pursuant to 35 U.S.C. § 119(a), patent application Serial No. CN201911024561.4 filed in China on Oct. 25, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector used to transmit high frequency signals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrical connector is used to connect two different electronic devices. To ensure large data and high speed transmission of electronic signals, high frequency requirements are mostly considered in the existing electrical connectors. Generally, the electrical connector includes an insulating body and a plurality of terminals, and the terminals are arranged and fixed onto the insulating body at certain intervals. Each terminal includes a fixing portion, and a left side and a right side of the fixing portion are clamped by the insulating body. An elastic arm is formed by extending from one end of the fixing portion. A front side and a back side of the fixing portion and the elastic arm are all exposed in the air. In this electrical connector, the front side and the back side of the fixing portion and the elastic arm are all exposed in the air, resulting in the electric field to be easily dissipated when the electrical connector is used to transmit high frequency signals, thus having ill capacitive resistance characteristics, affecting the quality of signal transmission, having a slow signal transmission speed, and resulting in high frequency loss and even crosstalk interference issues, thereby seriously affecting the completeness of the signals.

Therefore, a heretofore unaddressed need to design a novel electrical connector exists in the art to address the aforementioned deficiencies and inadequacies.

SUMMARY

In view of the deficiency of the background, the present invention is directed to an electrical connector, which is formed by a first main body and a second main body. The first main body and the second main body altogether limit the channel used to receive the signal terminals, thereby enhancing the dielectric coefficient of the surrounding environment of the signal terminal, adjusting the impedance of the signal terminal, and satisfying the matching impedance of the signal terminal required for transmission of high frequency signals.

To achieve the foregoing objective, the present invention adopts the following technical solutions.

An electrical connector is configured to be mated with a mating member. The electrical connector includes: a first main body, having a first wall surface, a second wall surface located at a front end of the first wall surface, and a front end surface located at a front end of the second wall surface; a second main body, mounted on the first main body, wherein the second main body has a third wall surface and a fourth wall surface located at a front end of the third wall surface, a first channel is formed between the first wall surface and the third wall surface, the first channel extends in a front-rear direction, a second channel is formed between the second wall surface and the fourth wall surface, and the second channel is provided obliquely forward and is in backward communication with the first channel; and a signal terminal, having a fixing portion and an elastic arm formed by extending obliquely forward from the fixing portion, wherein the fixing portion is accommodated in the first channel and fixed by at least one of the first main body and the second main body, the elastic arm is accommodated in the second channel, the elastic arm extends to form a contact portion, and the contact portion is exposed to the first main body in a left-right direction to be in contact with the mating member to form electrical connection therebetween.

In certain embodiments, the second main body is mounted on the first main body forward from back thereof.

In certain embodiments, the second wall surface is at least partially located at a front end of the fourth wall surface.

In certain embodiments, gaps exist respectively between the second wall surface and the elastic arm and between the fourth wall surface and the elastic arm.

In certain embodiments, the second wall surface and the fourth wall surface are provided in parallel to each other.

In certain embodiments, a width of the elastic arm in a longitudinal direction is greater than a width of the fourth wall surface in the longitudinal direction, and the longitudinal direction is perpendicular to the front-rear direction and the left-right direction respectively.

In certain embodiments, a width of the elastic arm in a longitudinal direction is greater than a width of the contact portion in the longitudinal direction, and the longitudinal direction is perpendicular to the front-rear direction and the left-right direction respectively.

In certain embodiments, the fixing portion is retained to the first main body, and the second main body abuts the fixing portion in the left-right direction.

In certain embodiments, a protruding rib is formed by protruding from the third wall surface toward the fixing portion, the protruding rib abuts the fixing portion in the left-right direction, a width of the protruding rib in a longitudinal direction is narrower than a width of the third wall surface in the longitudinal direction, and the longitudinal direction is perpendicular to the front-rear direction and the left-right direction respectively.

In certain embodiments, the electrical connector includes a plurality of signal terminals, wherein the first main body has a plurality of first wall surfaces and a plurality of second wall surfaces, the second main body has a plurality of third wall surfaces and a plurality of fourth wall surfaces, the first main body is formed with an insertion slot concavely provided on the front end surface, the first main body has two side walls located at two sides of the insertion slot, one of the two side walls is provided with a plurality of signal accommodating slots arranged along a longitudinal direction, the longitudinal direction is perpendicular to the front-rear direction and the left-right direction respectively, the signal accommodating slots are provided in communication with the insertion slot in the left-right direction, the contact portion protrudes into the insertion slot to be in contact with the mating member to form electrical connection therebetween, each of the signal accommodating slots accommodates one of the signal terminals, each of the signal accommodating slots is provided with the one of first wall surfaces and one of the second wall surfaces, and one of the third wall surfaces and one of the fourth wall surfaces are correspondingly accommodated in each of the signal accommodating slots.

In certain embodiments, the insertion slot has a slot bottom surface located at a back end thereof, the second main body has a base portion and a plurality of first portions formed by extending forward from the base portion, each of the first portions is provided with a corresponding one of the third wall surfaces and a corresponding one of the fourth wall surfaces, each of the signal accommodating slots accommodates a corresponding one of the first portions, and each of the first portions passes forward beyond the slot bottom surface.

In certain embodiments, each of the first portions has a first surface facing the insertion slot, and the first surface is provided to be recessed relative to a slot wall of the insertion slot.

In certain embodiments, each of the signal accommodating slots has two slot walls provided opposite to each other in the longitudinal direction, and a gap exists between each of the two slot walls of each signal accommodating slot and the corresponding first portion in the longitudinal direction.

In certain embodiments, the electrical connector includes a plurality of ground terminals, the one of the two side walls is further provided with a plurality of ground accommodating slots arranged along the longitudinal direction, the ground accommodating slots are provided to be in communication with the insertion slot in the left-right direction, each of the ground accommodating slots accommodates one of the ground terminals, the ground terminals protrude into the insertion slot to be in contact with the mating member to form electrical connection therebetween, and the ground accommodating slots and the signal accommodating slots on the same one of the two side walls are arranged in a row in the longitudinal direction.

In certain embodiments, the second main body has a plurality of second portions located on the base portion, the second portions and the first portions are located on a same side of the second main body in the front-rear direction, and each of the second portions is completely located at an outer side of one end of a corresponding one of the ground accommodating slots away from the front end surface in the front-rear direction.

In certain embodiments, each of the two side walls is provided with a plurality of signal accommodating slots and a plurality of ground accommodating slots arranged in one row, the first main body has a partition extending from the slot bottom surface toward a direction away from the front end surface in the front-rear direction, the partition separates the two rows of the signal accommodating slots and the ground accommodating slots on the two side walls, and a gap exists between each of the first portions and the partition in the left-right direction.

In certain embodiments, two adjacent ones of the signal accommodating slots are located between two adjacent ones of the ground accommodating slots in a same side wall, and two of the signal terminals accommodated in the two adjacent ones of the signal accommodating slots are configured to transmit differential signals.

In certain embodiments, each of the ground terminals has a fixing portion retained in the corresponding one of the ground accommodating slots, the one of the two side walls is provided with a plurality of notches corresponding to the fixing portions of the signal terminals and the fixing portions of the ground terminals, and each of the notches runs backward through the first main body.

In certain embodiments, a side of the one of the two side walls away from the insertion slot is covered by a metal member, the metal member is provided with a plurality of abutting arms corresponding to the ground terminals, and each of the abutting arms passes through a corresponding one of the notches and abuts the fixing portion of a corresponding one of the ground terminals.

In certain embodiments, the metal member shields the notches corresponding to the fixing portions of the signal terminals on the one of the two side walls.

Compared with the related art, the electrical connector according to certain embodiments of the present invention has the following beneficial effects. The fixing portion of each signal terminal are accommodated in the first channel, and the elastic arm of each signal terminal obliquely extending forward is accommodated in the second channel provided obliquely forward, thus increasing the dielectric coefficient of the surrounding environment of the signal terminals. The electric field is integrated when transmitting the high frequency signals, thus achieving the objective to enhance the electric field, such that the high frequency characteristics may develop toward capacitive resistance, reducing the loss of the high frequency signals and improving crosstalk, and providing a stable environment for transmission of the high frequency signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein:

FIG. 10 is a sectional view of FIG. 5 along a line C-C.

FIG. 11 is a schematic view of FIG. 5 sectioned along a line D-D with a signal terminal being hidden.

DETAILED DESCRIPTION

Figure 1:
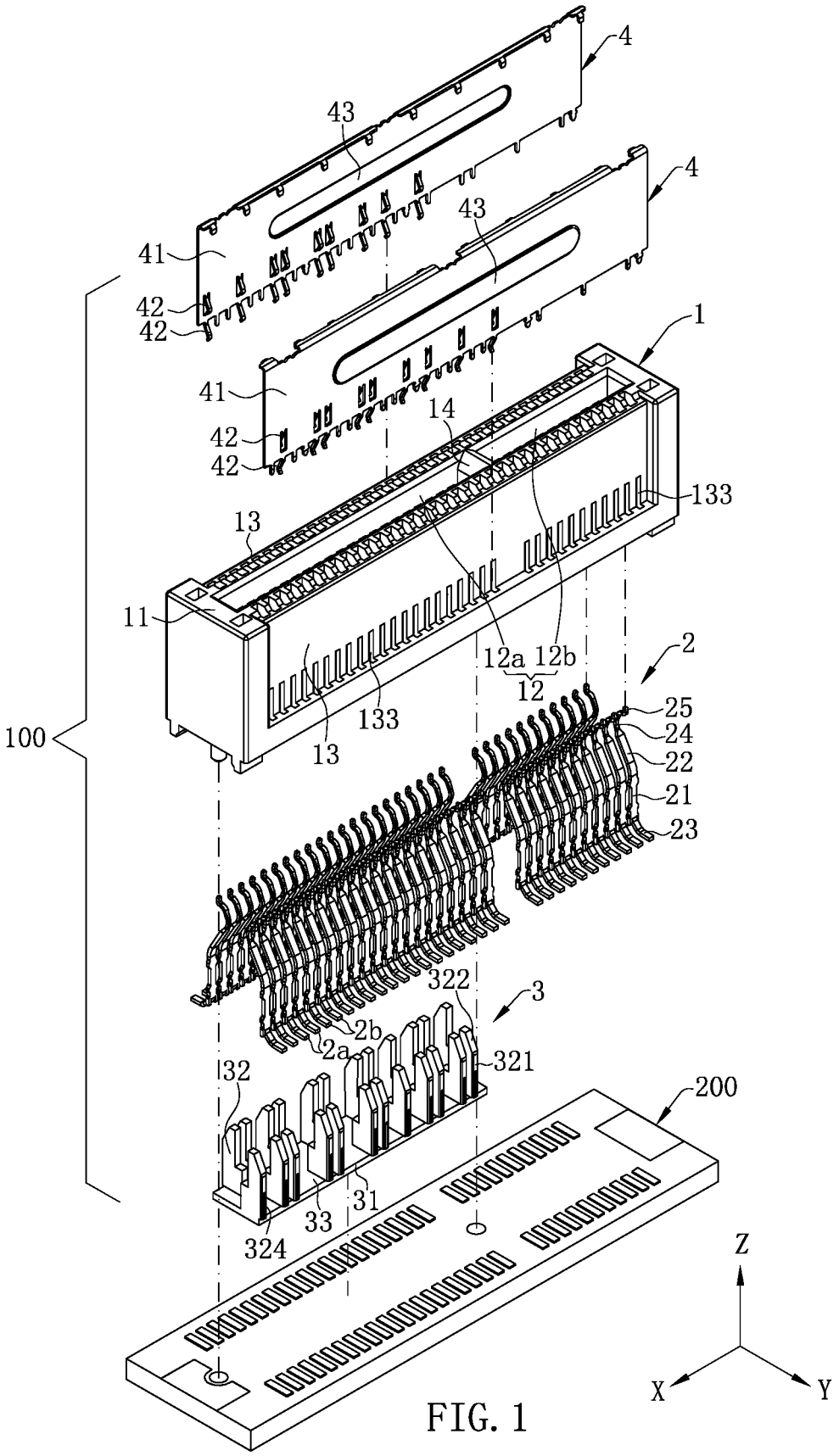
FIG. 1 is a perspective exploded view of an electrical connector and a circuit board according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to an electrical connector.

Figure 5:
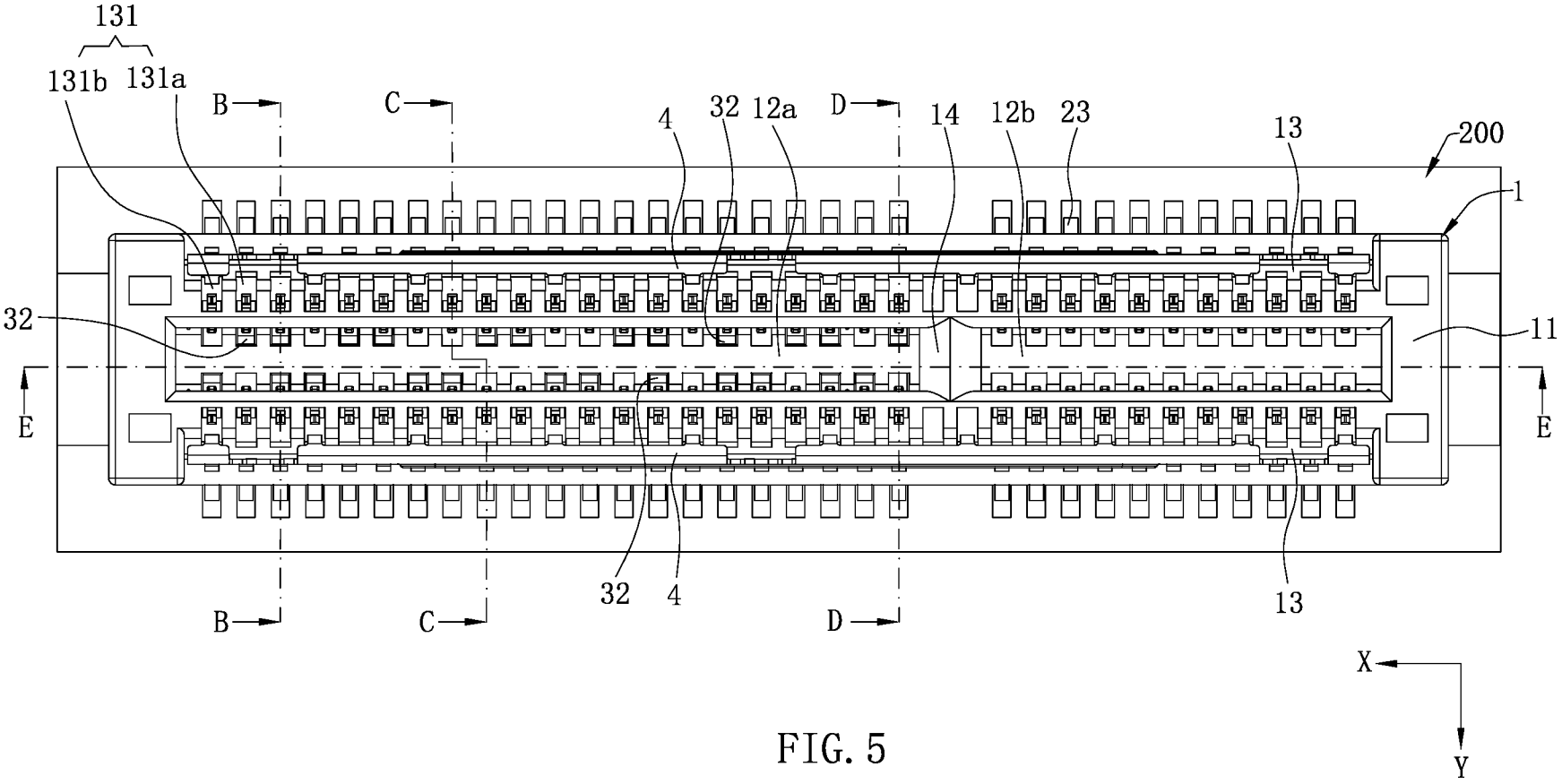
FIG. 5 is a top view of FIG. 3.
Figure 6:
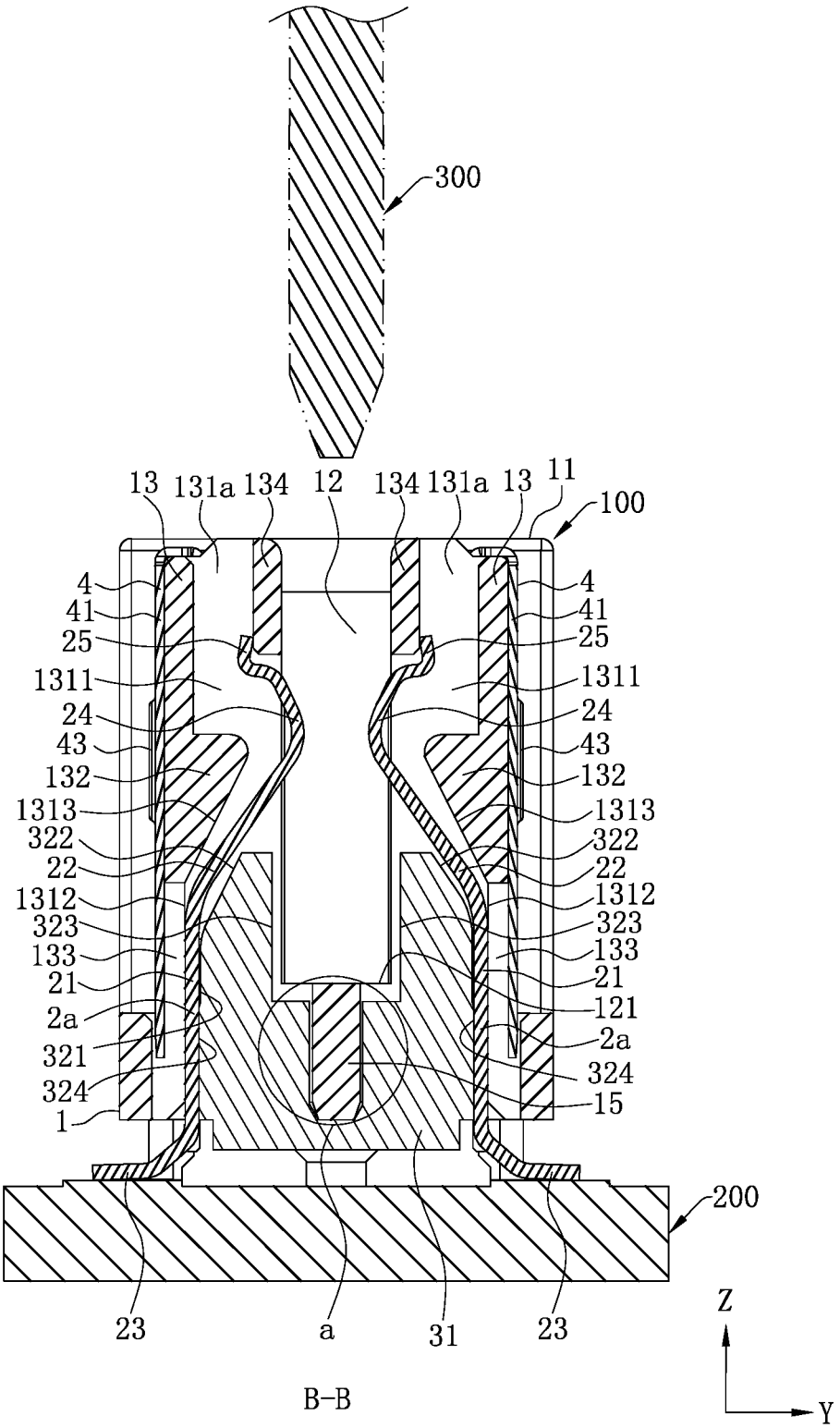
FIG. 6 is a schematic view of FIG. 5 sectioned along a line B-B without being inserted with the mating member.

FIG. 1, FIG. 5 and FIG. 6 show an electrical connector 100 according to certain embodiments of the present invention. The electrical connector 100 is mounted on a circuit board 200, and is used to be inserted with a mating member 300. For example, the mating member 300 is an electronic card. To conveniently describe the specific structures of the electrical connector 100, a longitudinal direction X, a left-right direction Y and a front-rear direction Z are defined, and each two of the longitudinal direction X, the left-right direction Y and the front-rear direction Z are perpendicular to each other. In this embodiment, the electrical connector 100 is mounted backward to the circuit board 200.

Figure 4:
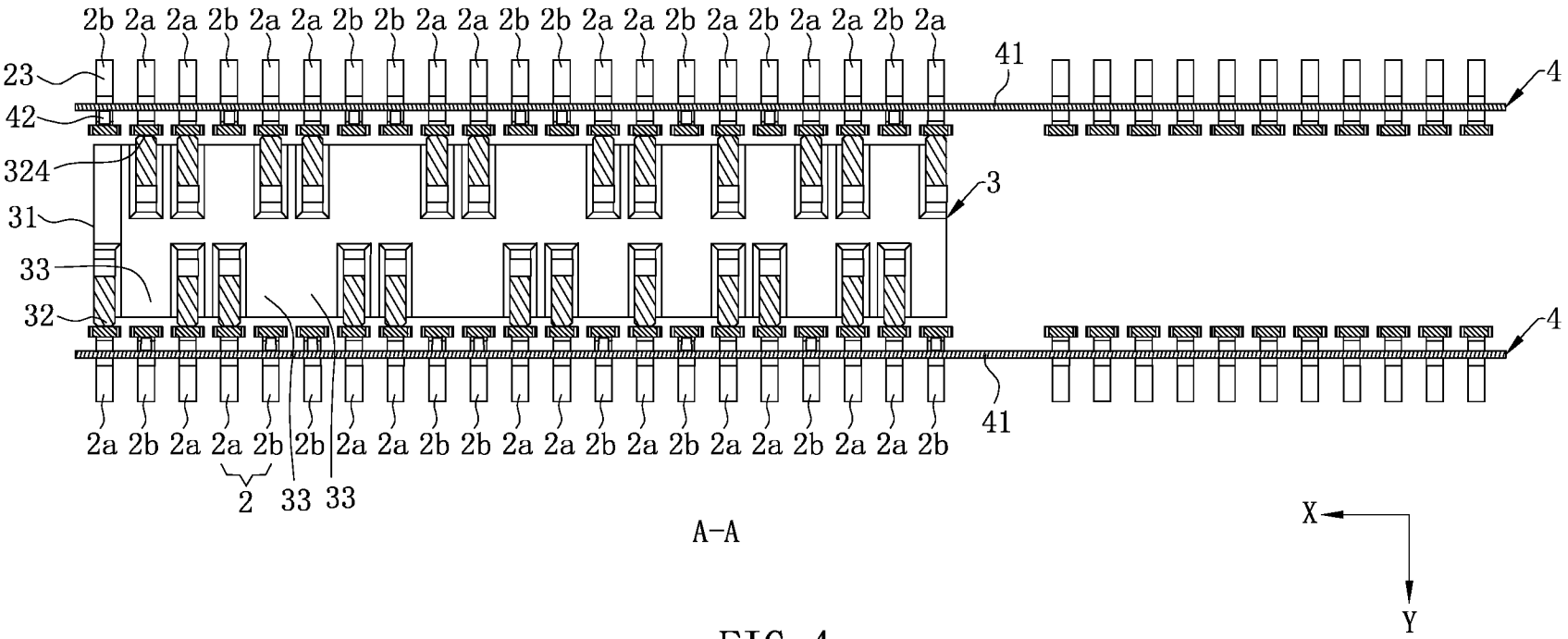
FIG. 4 is a schematic view of FIG. 3 sectioned along a line A-A and only showing the terminals, the second main body and the metal member.

As shown in FIG. 1 and FIG. 4, the electrical connector 100 includes a first main body 1, a plurality of terminals 2 provided in the first main body 1, a second main body 3 mounted on the first main body 1, and two metal members 4 shielded outside the first main body 1.

Figure 3:
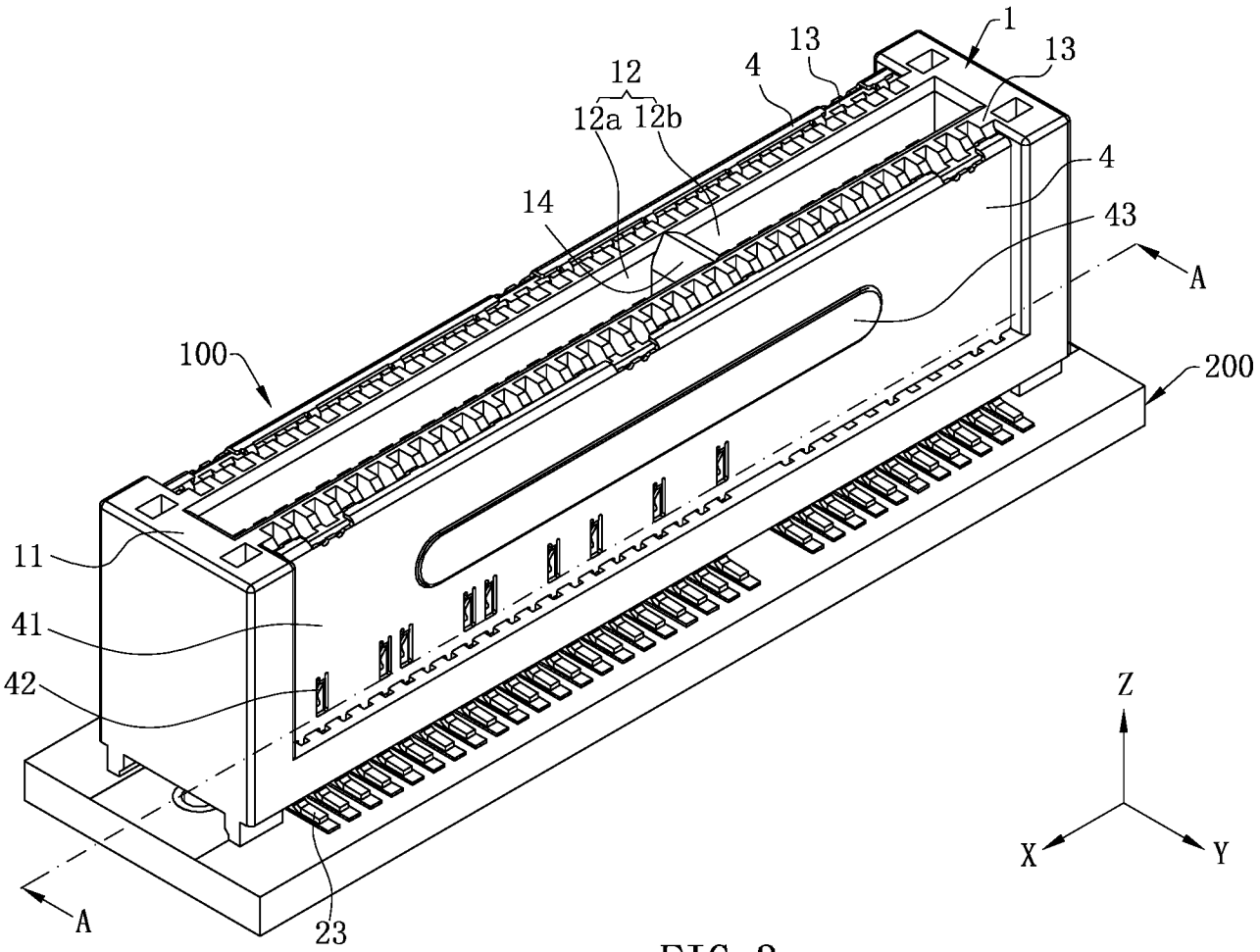
FIG. 3 is a perspective assembled view of the electrical connector and the circuit board in FIG. 1.

As shown in FIG. 1, FIG. 3 and FIG. 6, the first main body 1 is made by an insulating material, and has a mating surface 11 at its front end. In this embodiment, the front end surface of the first main body 1 serves as the mating surface 11. The first main body 1 has an insertion slot 12 formed by recessing backward from the mating surface 11, and two side walls 13 located at two opposite sides of the insertion slot 12. The two side walls 13 are provided at an interval in the left-right direction Y. The insertion slot 12 extends along the longitudinal direction X, and is used for the mating member 300 to insert backward therein. The insertion slot 12 has a slot bottom surface 121 at its back end.

Figure 13:
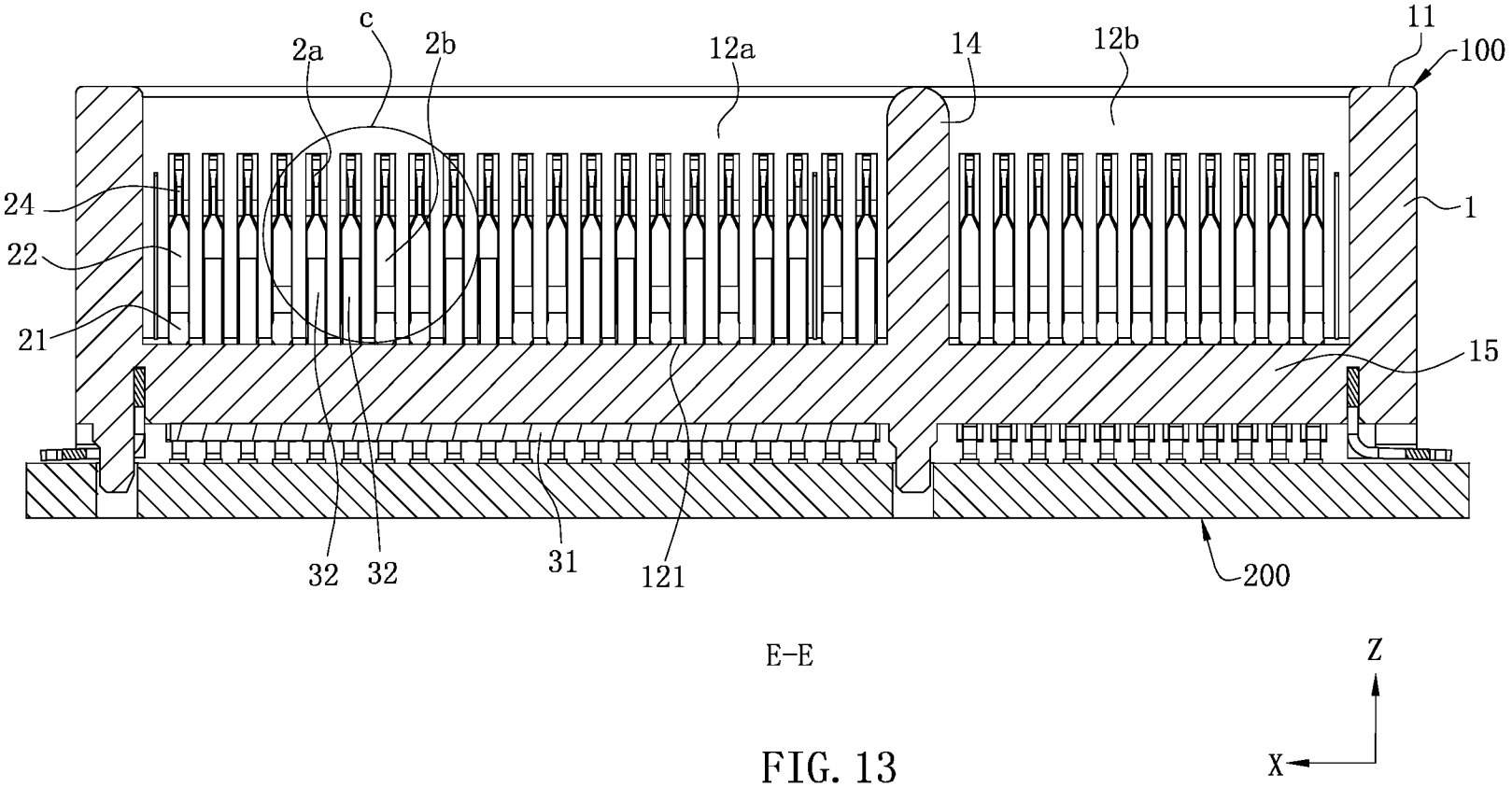
FIG. 13 is a sectional view of FIG. 5 along a line E-E.

As shown in FIG. 3, FIG. 5 and FIG. 13, the first main body 1 has a foolproof portion 14 located in the insertion slot 12 and connecting the two side walls 13. The foolproof portion 14 is formed by extending from the slot bottom surface 121 toward the mating surface 11. The foolproof portion 14 and the side walls 13 are injection-molded. The foolproof portion 14 divides the insertion slot 12 into a long slot 12*a* and a short slot 12*b* having different lengths in the longitudinal direction X.

Figure 15:
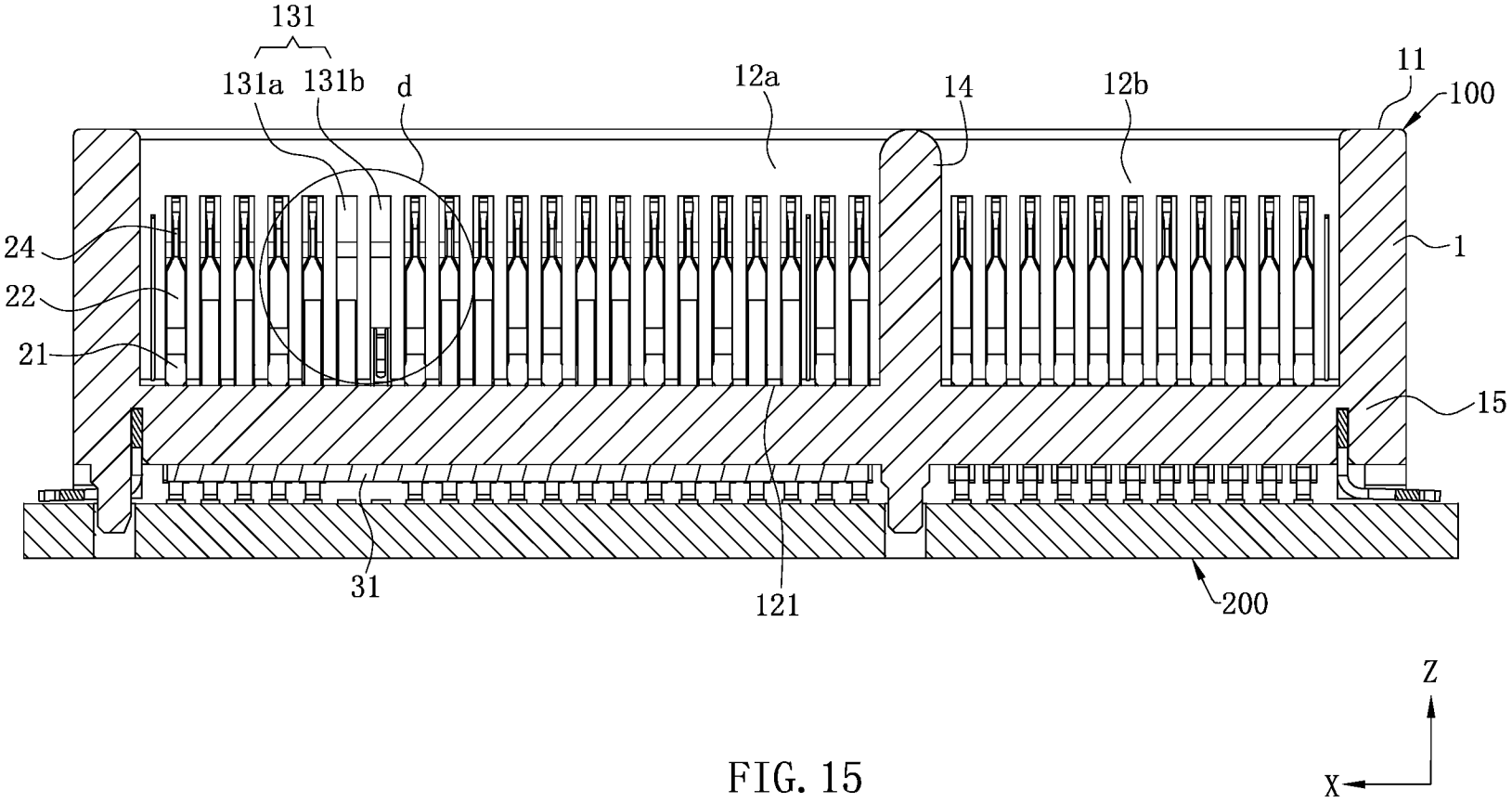
FIG. 15 is a schematic view of FIG. 13 with a signal terminal and a ground terminal being hidden.
Figure 16:
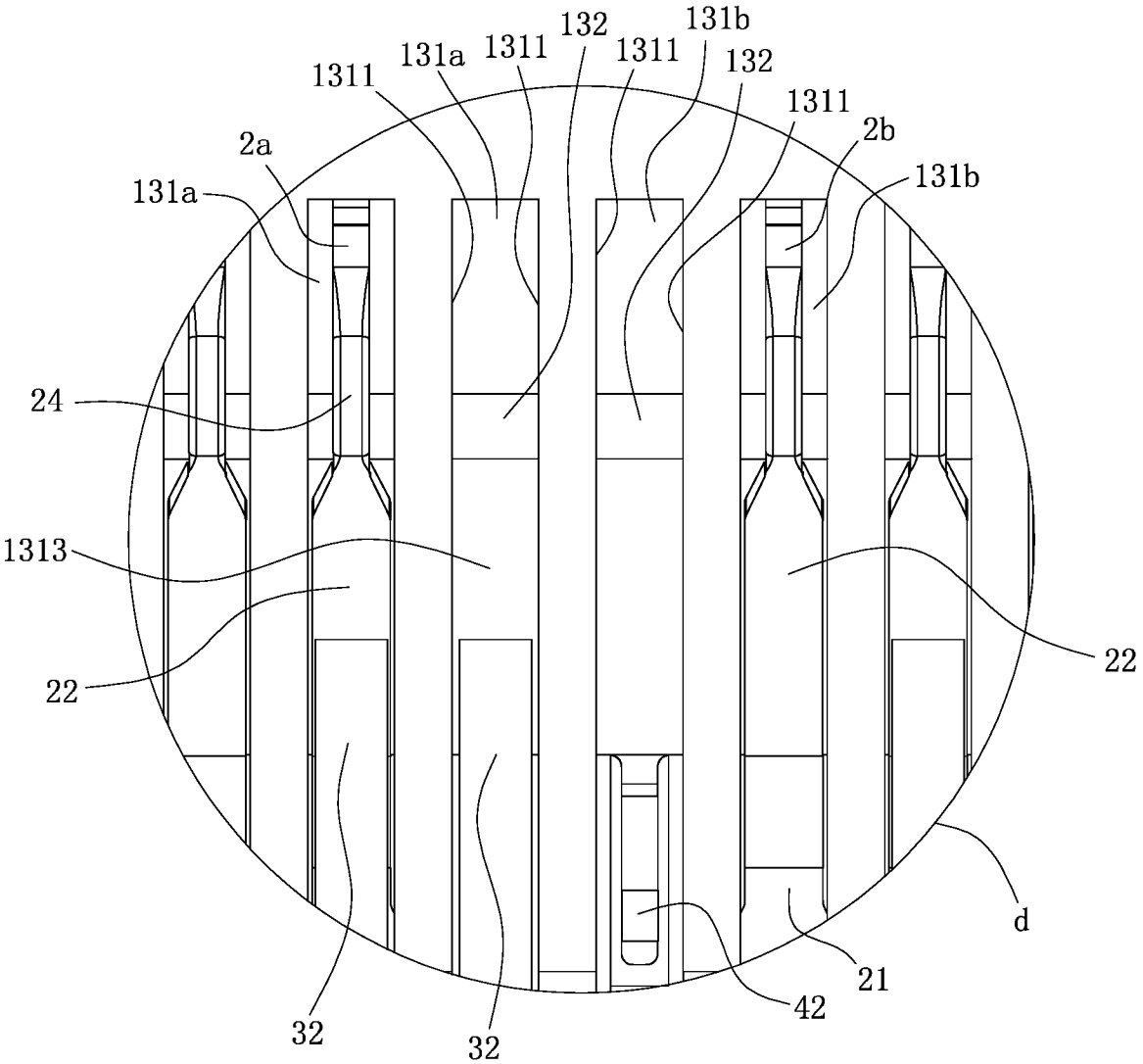
FIG. 16 is an enlarged view of a portion din FIG. 15.

As shown in FIG. 5, FIG. 15 and FIG. 16, each side wall 13 is provided with a plurality of accommodating slots 131 arranged in a row along the longitudinal direction X. The accommodating slots 131 include a plurality of signal accommodating slots 131*a* and a plurality of ground accommodating slots 131*b*. Each of the signal accommodating slots 131*a* and the ground accommodating slots 131*b* has two slot walls 1311 provided opposite to each other in the longitudinal direction X, and each of the signal accommodating slots 131*a* and the ground accommodating slots 131*b* is in communication with the insertion slot 12 in the left-right direction Y and runs through the corresponding side wall 13 in the front-rear direction Z respectively. The accommodating slots 131 has a plurality of signal accommodating slots 131*a* provided in pairs, and a plurality of ground accommodating slots 131*b* provided in pairs, and the signal accommodating slots 131*a* in pairs and the ground accommodating slots 131*b* in pairs are arranged alternately along the longitudinal direction X. In this embodiment, the structures of the signal accommodating slots 131*a* and the ground accommodating slots 131*b* on the same side wall 13 are identical, and the signal accommodating slots 131*a* in pairs on one of the two side walls 13 and the ground accommodating slots 131*b* in pairs on the other of the two side walls 13 are provided symmetrically in the left-right direction Y.

As shown in FIG. 6 and FIG. 10, the first main body 1 has a partition 15. The partition 15 extends from the slot bottom surface 121 toward a direction away from the mating surface 11 in the front-rear direction Z, and separates the two rows of the accommodating slots 131 on the two side walls 13 from each other. A portion of each signal accommodating slot 131*a* and a portion of each ground accommodating slot 131*b* are located behind the slot bottom surface 121.

As shown in FIG. 6 and FIG. 10, each side wall 13 of the first main body 1 has a plurality of protruding portions 132 protruding toward the signal accommodating slots 131*a* and the ground accommodating slots 131*b* respectively. In other words, one protruding portion 132 is provided in each signal accommodating slot 131*a*, and one protruding portion 132 is provided in each ground accommodating slot 131*b*. Each protruding portion 132 is formed by protruding toward the insertion slot 12 in the left-right direction Y. In this embodiment, each protruding portion 132 is located in front of the slot bottom surface 121 in the front-rear direction Z.

Figure 12:
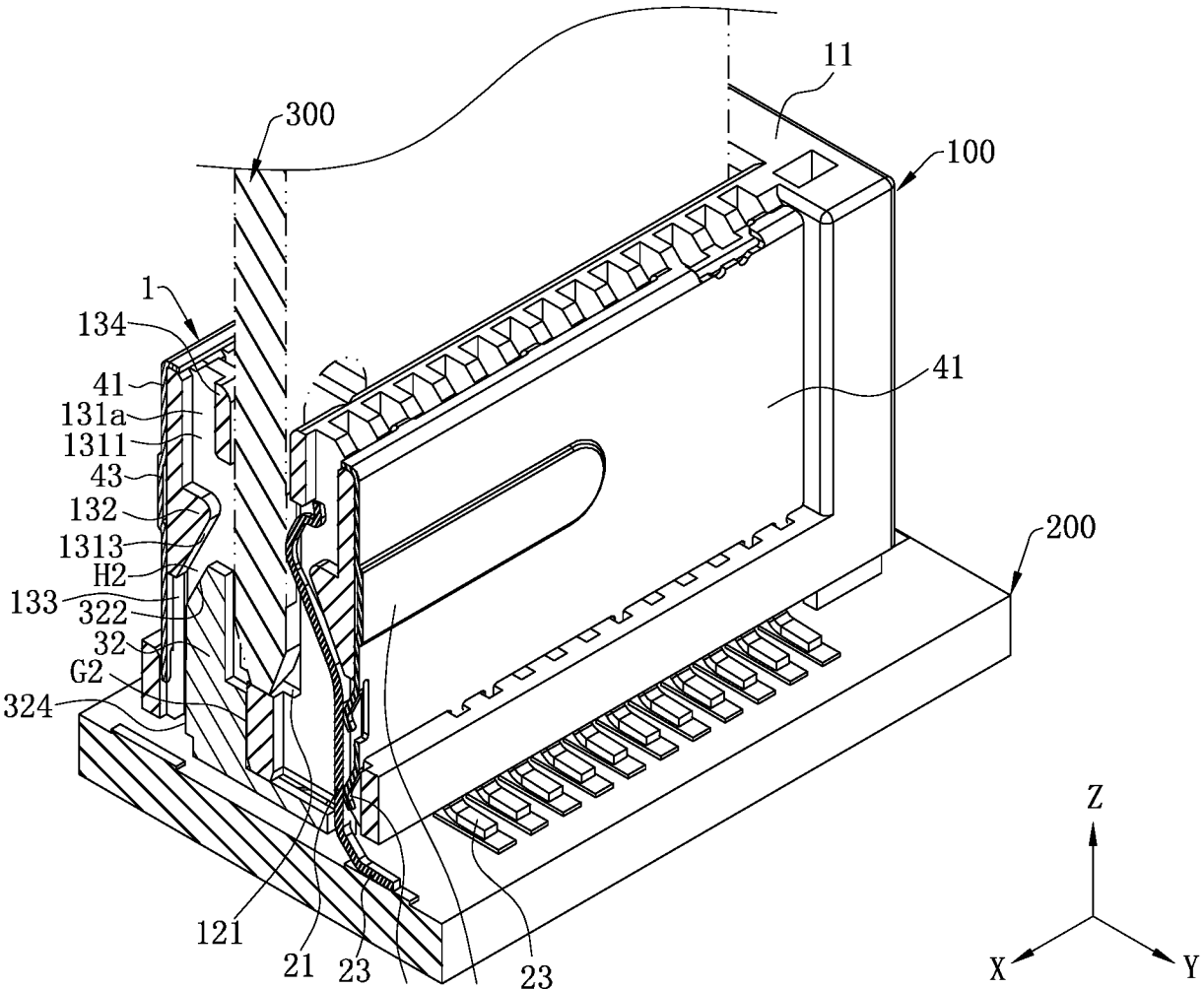
FIG. 12 is perspective view of FIG. 11.

As shown in FIG. 12 and FIG. 16, each protruding portion 132 connects the two slot walls 1311 of the corresponding accommodating slots 131 in the longitudinal direction X.

As shown in FIG. 11 and FIG. 12, each signal accommodating slot 131*a* has a first wall surface 1312 and a second wall surface 1313 located at a front end of the first wall surface 1312. The first wall surface 1312 extends along the front-rear direction Z, and connects the two slot walls 1311 of the corresponding signal accommodating slot 131*a*. The first wall surface 1312 is located at a side of the corresponding signal accommodating slot 131*a* away from the insertion slot 12 in the left-right direction Y. The second wall surface 1313 is located on the corresponding protruding portion 132, and the second wall surface 1313 extends obliquely toward the mating surface 11 and the insertion slot 12.

As shown in FIG. 1, FIG. 6 and FIG. 10, each side wall 13 is provided with a plurality of notches 133. Each signal accommodating slot 131*a* is in communication with one of the notches 133, and each ground accommodating slot 131*b* is in communication with one of the notches 133. Each notch 133 is located at a side of the corresponding signal accommodating slot 131*a* and the corresponding ground accommodating slot 131*b* away from the insertion slot 12 in the left-right direction Y, and each notch 133 runs outward through the corresponding side wall 13 in the left-right direction Y and partially runs backward through the corresponding side wall 13.

As shown in FIG. 6 and FIG. 10, the first main body 1 is provided with a plurality of pre-pressurized blocks 134 in the signal accommodating slots 131*a* and the ground accommodating slots 131*b*. In other words, one pre-pressurized block 134 is provided in each signal accommodating slot 131*a*, and one pre-pressurized block 134 is provided in each ground accommodating slot 131*b*. Each pre-pressurized block 134 is provided closer to the mating surface 11 than the corresponding protruding portion 132 and is adjacent to the insertion slot 12. Each protruding portion 132 extends toward the insertion slot 12 and does not pass beyond a side edge of the corresponding pre-pressurized block 134 away from the insertion slot 12.

As shown in FIG. 1 and FIG. 4, the terminals 2 include at least one signal terminal 2*a* and at least one ground terminal 2*b*. The structures and sizes of the signal terminal 2*a* and the ground terminal 2*b* are identical. In this embodiment, a plurality of signal terminals 2*a* and a plurality of ground terminals 2*b* are provided.

Figure 14:
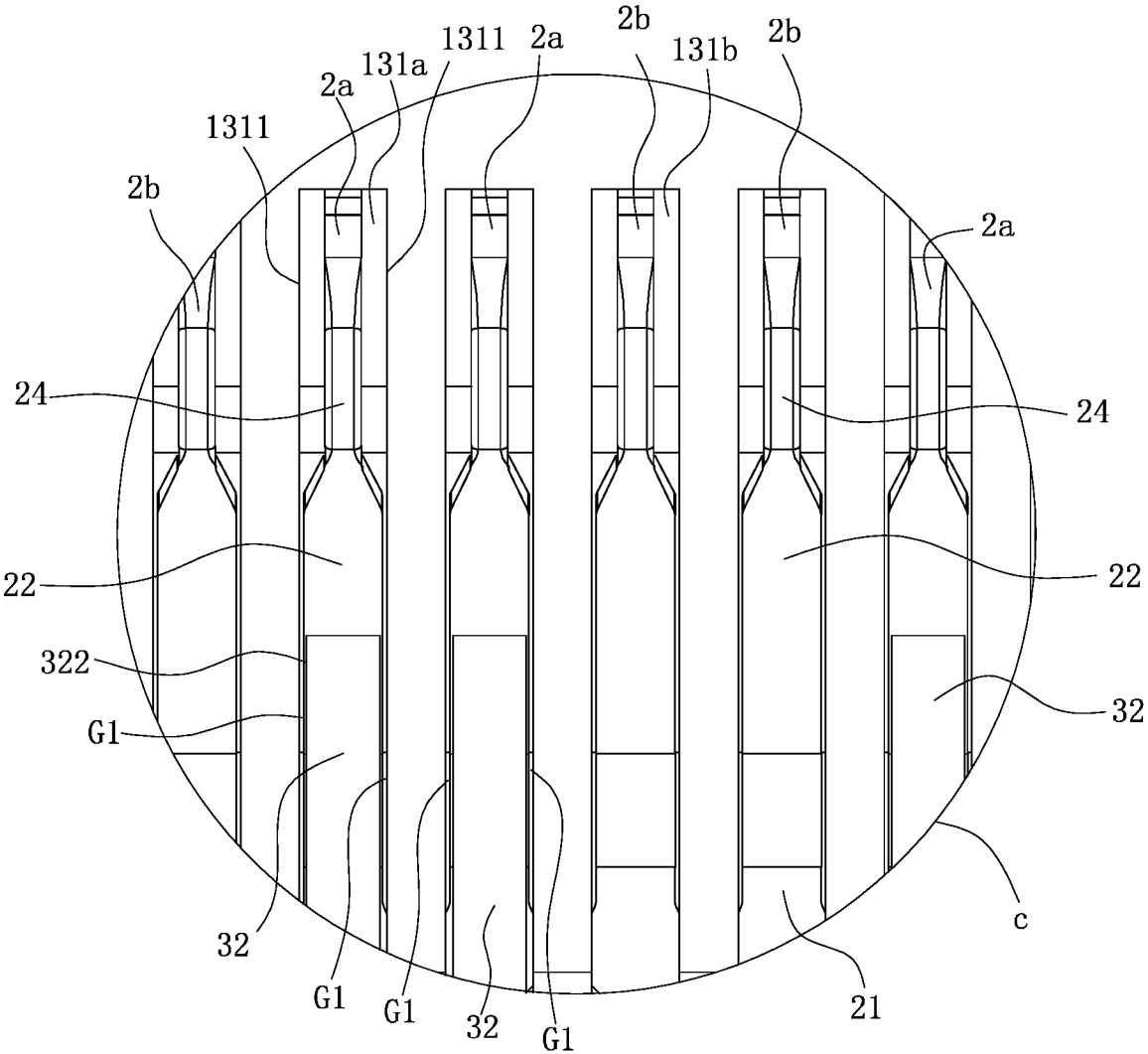
FIG. 14 is an enlarged view of a portion c in FIG. 13.

As shown in FIG. 1, FIG. 13 and FIG. 14, each signal accommodating slot 131*a* correspondingly accommodates a signal terminal 2*a*, and each ground accommodating slot 131*b* correspondingly accommodates a ground terminal 2*b*. The two signal terminals 2*a* accommodated in the two adjacent signal accommodating slots 131*a* are used to transmit differential signals.

As shown in FIG. 6 and FIG. 10, each terminal 2 has a fixing portion 21, where the fixing portion 21 is retained to the first main body 1, an elastic arm 22 formed by obliquely extending from the fixing portion 21 toward the mating surface 11 and the insertion slot 12, and a soldering portion 23 formed by extending backward from the fixing portion 21. The elastic arm 22 extends to form a contact portion 24. The contact portion 24 protrudes into the insertion slot 12 to be in contact with the mating member 300 to form electrical connection therebetween. The fixing portion 21 of each signal terminal 2*a* is retained in a corresponding signal accommodating slot 131*a*, and the fixing portion 21 of each ground terminal 2*b* is retained in a corresponding ground accommodating slot 131*b*. The second wall surface 1313 faces the elastic arm 22, and is provided closer to the mating surface 11 than the elastic arm 22. A pre-pressurized portion 25 is formed by extending obliquely from the contact portion 24 toward the mating surface 11 and the accommodating slots 131. The pre-pressurized portion 25 abuts a corresponding pre-pressurized block 134 prior to the mating member 300 being inserted into the insertion slot 12. Such design allows the depths of the contact portions 24 of the terminals 2 protruding into the insertion slot 12 to maintain consistent. The soldering portion 23 extends backward out of the first main body 1 to be soldered to the circuit board 200 to form electrical connection therebetween.

As shown in FIG. 13 and FIG. 14, a width of the elastic arm 22 in the longitudinal direction X is greater than a width of the fourth wall surface 322 in the longitudinal direction X, and the width of the elastic arm 22 in the longitudinal direction X is greater than a width of the contact portion 24 in the longitudinal direction X.

Figure 2:
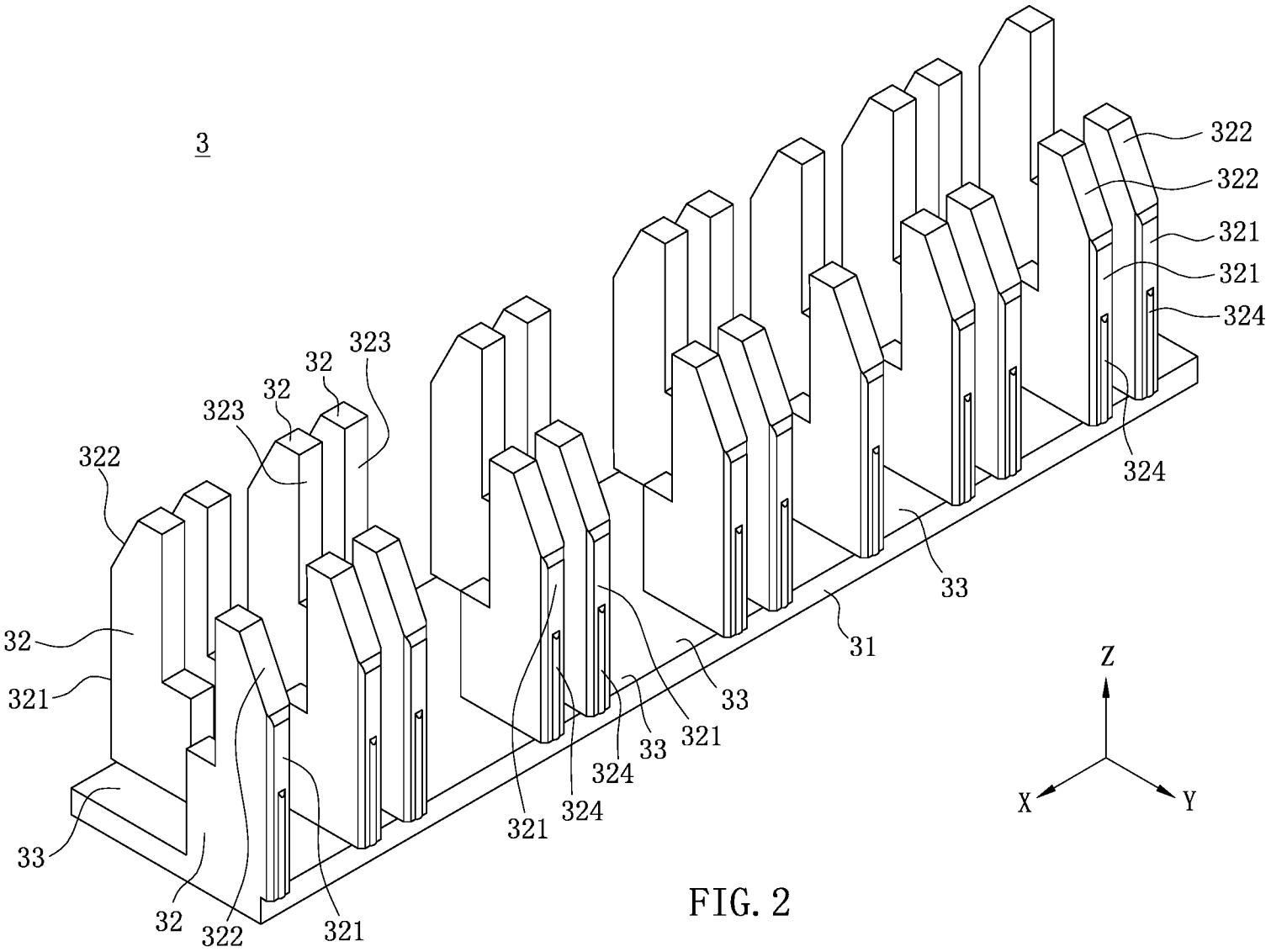
FIG. 2 is a perspective view of a second main body in FIG. 1.

As shown in FIG. 2, FIG. 12 and FIG. 13, the second main body 3 is mounted to the first main body 1 corresponding to the location of the long slot 12*a* forward from back thereof. The second main body 3 is made by an insulating material, and has a base portion 31. The base portion 31 is provided to correspond to the location of the long slot 12*a*, and a length of the base portion 31 along the longitudinal direction X is substantially equal to a length of the long slot 12*a* in the longitudinal direction X. A plurality of first portions 32 are formed by extending forward from the base portion 31. Each signal accommodating slot 131*a* correspondingly accommodates one of the first portions 32. A front end of each first portion 32 is closer to the mating surface 11 than the slot bottom surface 121. In other words, each first portion 32 is provided to partially pass beyond the slot bottom surface 121.

As shown in FIG. 5 and FIG. 16, in the longitudinal direction, a first gap G1 exists between each first portion 32 and the two slot walls 131 of the corresponding signal accommodating slot 131*a*.

Figure 7:
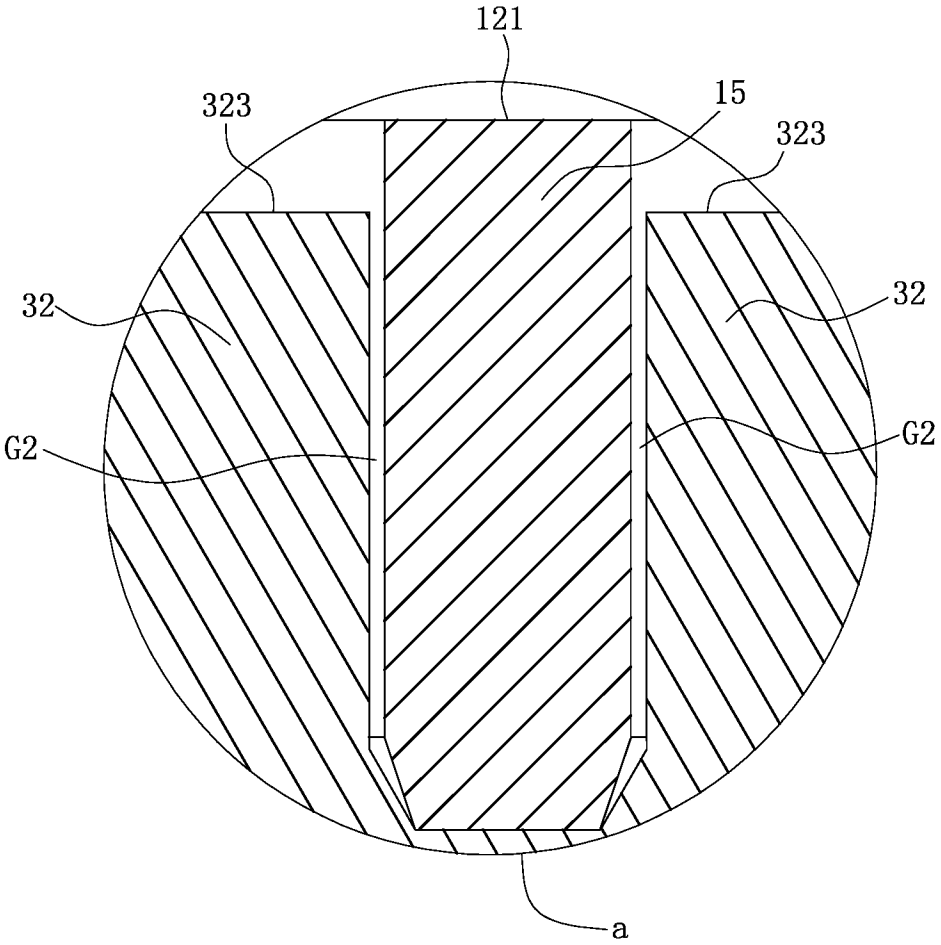
FIG. 7 is an enlarged view of a portion a in FIG. 6.

As shown in FIG. 6 and FIG. 7, a second gap G2 exists between each first portion 32 and the partition 15 in the left-right direction Y, allowing each first portion 32 to be smoothly inserted into the corresponding signal accommodating slot 131*a*.

As shown in FIG. 2, FIG. 6 and FIG. 11, each first portion 32 has a third wall surface 321 and a fourth wall surface 322 located at a front end of the third wall surface 321. The third wall surface 321 extends along the front-rear direction Z, and the fourth wall surface 322 extends obliquely toward the mating surface 11 and the insertion slot 12. In this embodiment, the second wall surface 1313 and the fourth wall surface 322 are provided to be parallel to each other. The second wall surface 1313 and the fourth wall surface 322 are both oblique surfaces, and the second wall surface 1313 is at least partially located at a front end of the fourth wall surface 322. The first wall surface 1312 and the third wall surface 321 are opposite to each other in the left-right direction, forming a first channel H1 therebetween. A second channel H2 is formed between the second wall surface 1313 and the fourth wall surface 322. The second channel H2 is in backward communication with the corresponding first channel H1. The fixing portion 21 of each signal terminal 2*a* is accommodated in the corresponding first channel H1, and the elastic arm 22 of each signal terminal 2*a* is accommodated in the corresponding second channel H2. Gaps exists between the second wall surface 1313 and the elastic arm 22 and between the fourth wall surface 322 and the elastic arm 22 respectively, thus providing reserved spaces for the elastic arm 22 to elastically deform when being applied with a force.

Figure 8:
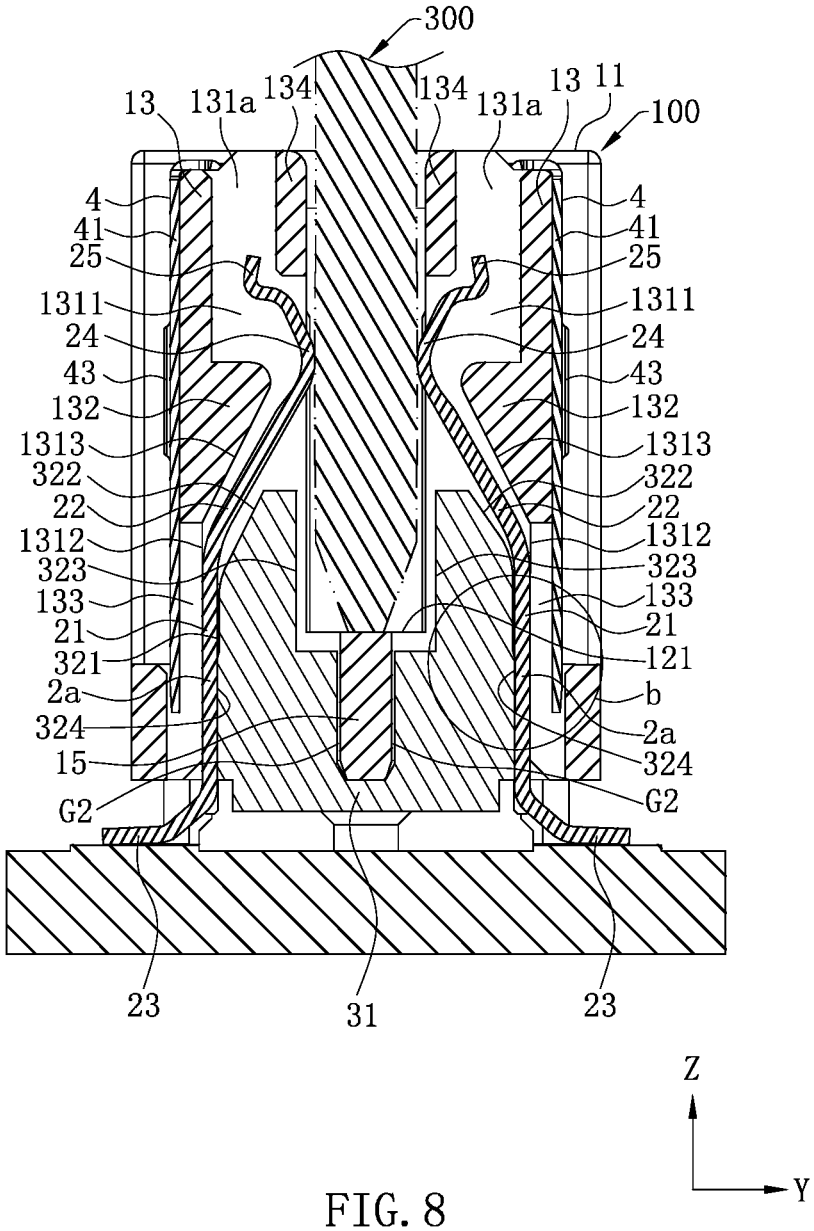
FIG. 8 is a schematic view of FIG. 6 being inserted with the mating member.

As shown in FIG. 6 and FIG. 8, each first portion 32 has a first surface 323 facing the insertion slot 12 in the left-right direction Y. The first surface 323 is provided to be recessed relative to a corresponding slot wall of the insertion slot 12, thus preventing each first portion 32 from protruding into the insertion slot 12 and affecting the insertion of the mating member 300 and the electrical connection between the mating member 300 and the contact portion 24.

Figure 9:
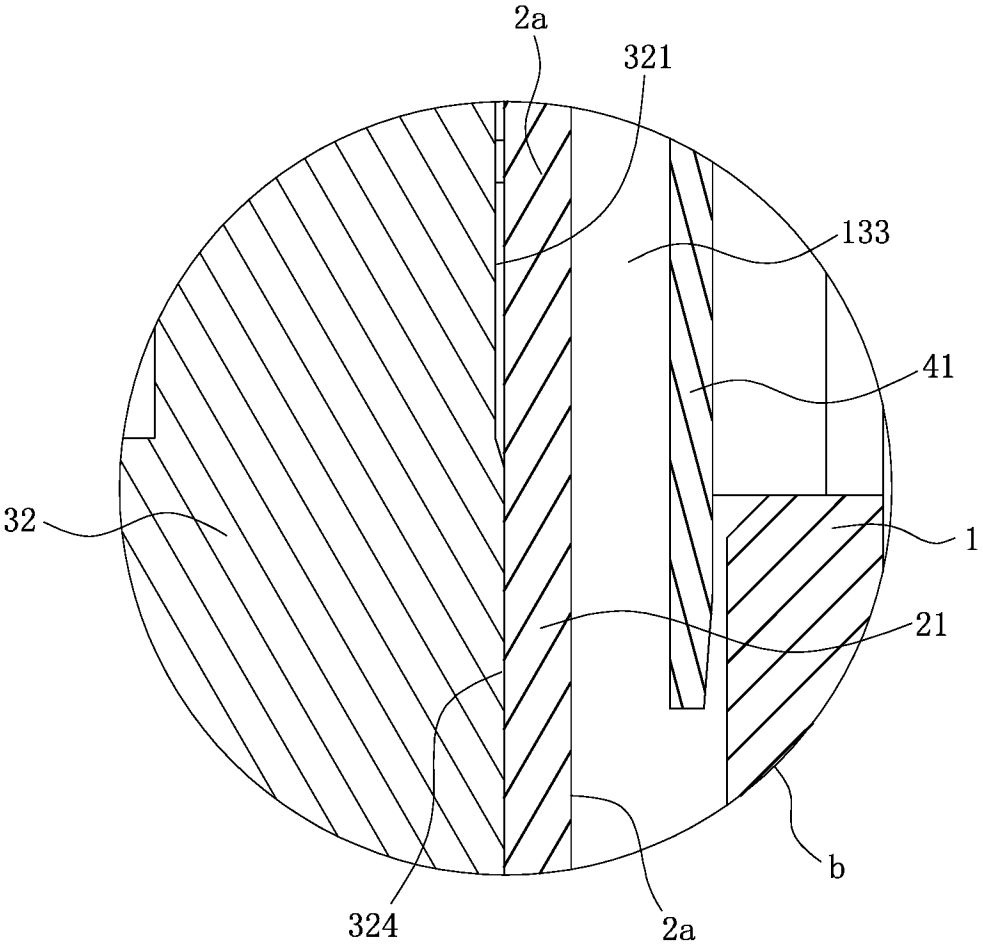
FIG. 9 is an enlarged view of a portion b in FIG. 8.

As shown in FIG. 2, FIG. 8 and FIG. 9, each first portion 32 is provided with a protruding rib 324 protruding from the third wall surface 321 toward the direction away from the insertion slot 12. That is, the protruding rib 324 is formed by protruding from the third wall surface 321 toward the fixing portion 21 of the corresponding signal terminal 2*a*. The protruding rib 324 and the fixing portion 21 of the corresponding signal terminal 2*a* are in interference fit, such that the second main body 3 is fixed by the interference fit of the protruding ribs 324 and the fixing portions 21 of the signal terminals 2*a* in two rows, and does not easily detach backward from the first main body 1.

As shown in FIG. 2, FIG. 10 and FIG. 12, the base portion 31 is provided with a second portion 33 corresponding to each ground accommodating slot 131*b*. The first portion 32 is provided closer to the mating surface 11 than the second portion 33. In this embodiment, the second portion 33 is provided to be farther away from the mating surface 11 than the slot bottom surface 121, and the second portion 33 is completely located at an outer side of one end of the corresponding ground accommodating slot 131*b* away from the mating surface 11. In this embodiment, the second portion 33 partially shields the corresponding ground accommodating slot 131*b*. In other embodiments, the second portion 33 may protrude into the corresponding ground accommodating slot 131*b*.

As shown in FIG. 1, FIG. 8 and FIG. 10, the two metal members 4 are separated structures. Each metal member 4 is a sheet structure formed by punching a metal plate. The two metal members 4 are provided on the two side walls 13, and each metal member 4 is provided on a side of the corresponding side wall 13 away from the insertion slot 12. Each metal member 4 has a flat plate portion 41, and each metal member 4 is provided with a plurality of abutting arms 42 extending from the flat plate portion 41 toward the direction away from the mating surface 11. Each abutting arm 42 is cantilever shaped. Two abutting arms 42 aligning in the front-rear direction Z pass inward through the same notch 133 and abut the fixing portion 21 of the same ground terminal 2*b*, thus facilitating high frequency transmission. The flat plate portion 41 shields the notches 133 corresponding to the fixing portions 21 of the signal terminals 2*a*, thus reducing the electromagnetic interference to the signal terminals 2*a* from the outer environment. In other embodiments, the two metal members 4 may support an integral structure.

As shown in FIG. 1, FIG. 3 and FIG. 10, each metal member 4 further has a strengthening portion 43 located in front of the abutting arms 42. That is, the strengthening portion 43 is provided closer to the mating surface 11 relative to the abutting arms 42. The strengthening portion 43 is a protrusion of the metal member 4 formed on the flat plate portion 41 toward the direction away from the insertion slot 12 and extends in the front-rear direction Z and the longitudinal direction X. A length of the strengthening portion 43 extending in the longitudinal direction X is greater than a length of the strengthening portion 43 extending in the front-rear direction Z. Thus, the strengthening portion 43 is provided on the flat plate portion 41 of the metal member 4 in a long strip shape.

In sum, the electrical connector according to certain embodiments of the present invention has the following beneficial effects:

(1) The first wall surface 1312 of the first main body 1 and the third wall surface 321 of the second main body 3 correspond to each other, thus forming the first channel H1 extending in the front-rear direction to accommodate the fixing portions 21 of the signal terminals 2*a*. The second wall surface 1313 of the first main body 1 and the fourth wall surface 322 of the second main body 3 correspond to each other, thus forming the second channel H2 obliquely extending forward from the first channel H1 to accommodate the elastic arms 22 of the signal terminals 2*a*. Compared to the related art, the first main body 1 and the second main body 3 altogether increase the dielectric coefficient of the surrounding environment of the signal terminals 2*a*, and the electric field is integrated when transmitting the high frequency signals, thus achieving the objective to enhance the electric field, such that the high frequency characteristics may develop toward capacitive resistance, reducing the loss of the high frequency signals and improving crosstalk, and providing a stable environment for transmission of the high frequency signals.

(2) The second main body 3 is provided with a first portion 32 corresponding to the signal accommodating slot 131*a* and a second portion 33 corresponding to the ground accommodating slot 131*b*. The first portion 32 is provided closer to the mating surface 11 of the first main body 1 than the second portion 33. That is, the change to the dielectric coefficient of the surrounding environment of the signal terminal 2*a* by the second main body 3 is greater than the change to the dielectric coefficient of the surrounding environment of the ground terminal 2*b*. Such configuration may be used to adjust the impedance of the signal terminal 2*a*, and to satisfy the matching impedance of the signal terminal 2*a* required for transmission of high frequency signals.

(3) The first gap G1 exists between each first portion 32 and each of the two slot walls 1311 of the corresponding signal accommodating slot 131*a* in the longitudinal direction X, and the second gap G2 exists between each first portion 32 and the partition 15 in the left-right direction Y, allowing each first portion 32 to be smoothly inserted into the corresponding signal accommodating slot 131*a*. Further, gaps exists between the second wall surface 1313 and the elastic arm 22 of each signal terminal 2*a* and between the fourth wall surface 322 and the elastic arm 22 of each signal terminal 2*a* respectively, thereby providing reserved spaces for the elastic arm 22 to elastically deform when being applied with a force.

(4) The first surface 323 of each first portion 32 facing the insertion slot 12 is provided to be recessed relative to the corresponding slot wall of the insertion slot 12 in the left-right direction Y, thus preventing each first portion 32 from protruding into the insertion slot 12 and affecting the insertion of the mating member 300 and the electrical connection between the mating member 300 and the contact portion 24.

(5) The abutting arms 42 of the metal members 4 abut the fixing portions 21 of the ground terminals 2*b*, thereby increasing backflow paths and improving the grounding effect. Each metal member 4 shields the notches 133 corresponding to the fixing portions 21 of the signal terminals 2*a*, thus reducing the electromagnetic interference to the signal terminals 2*a* from the outer environment.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be mated with a mating member, the electrical connector comprising:

a first main body, having a first wall surface, a second wall surface located at a front end of the first wall surface, and a front end surface located at a front end of the second wall surface;

a second main body, mounted on the first main body, wherein the first main body and the second main body are provided separately, the second main body has a third wall surface and a fourth wall surface located at a front end of the third wall surface, a first channel is formed between the first wall surface and the third wall surface, the first channel extends in a front-rear direction, a second channel is formed between the second wall surface and the fourth wall surface, and the second channel is provided obliquely forward and is in backward communication with the first channel; and a plurality of signal terminals, each having a fixing portion and an elastic arm formed by extending obliquely forward from the fixing portion, wherein the fixing portion is accommodated in the first channel and fixed by at least one of the first main body and the second main body, the elastic arm is accommodated in the second channel, the elastic arm extends to form a contact portion, and the contact portion is exposed to the first main body in a left-right direction to be in contact with the mating member to form electrical connection therebetween;

wherein the first main body has a plurality of first wall surfaces and a plurality of second wall surfaces, the second main body has a plurality of third wall surfaces and a plurality of fourth wall surfaces, the first main body is formed with an insertion slot concavely provided on the front end surface, the first main body has two side walls located at two sides of the insertion slot, one of the two side walls is provided with a plurality of signal accommodating slots arranged along a longitudinal direction, the longitudinal direction is perpendicular to the front-rear direction and the left-right direction respectively, the signal accommodating slots are provided in communication with the insertion slot in the left-right direction, the contact portion protrudes into the insertion slot to be in contact with the mating member to form electrical connection therebetween, each of the signal accommodating slots accommodates one of the signal terminals, each of the signal accommodating slots is provided with one of the first wall surfaces and one of the second wall surfaces, and one of the third wall surfaces and one of the fourth wall surfaces are correspondingly accommodated in each of the signal accommodating slots.

2. The electrical connector according to claim 1, wherein the second main body is mounted on the first main body forward from back thereof.

3. The electrical connector according to claim 1, wherein the second wall surfaces are one-to-one correspond to the fourth wall surfaces, and each of the second wall surfaces is at least partially located at a front end of a corresponding one of the fourth wall surfaces.

4. The electrical connector according to claim 1, wherein gaps exist respectively between each of the second wall surfaces and the elastic arm of a corresponding one of the signal terminals and between each of the fourth wall surfaces and the elastic arm of the corresponding one of the signal terminals.

5. The electrical connector according to claim 1, wherein the fixing portion of each of the signal terminals is retained to the first main body, and the second main body abuts the fixing portion of each of the signal terminals in the left-right direction.

6. The electrical connector according to claim 5, wherein a protruding rib is formed by protruding from each of the third wall surfaces toward the fixing portion of a corresponding one of the signal terminals, the protruding rib abuts the fixing portion of the corresponding one of the signal terminals in the left-right direction, and a width of the protruding rib in the longitudinal direction is narrower than a width of each of the third wall surfaces in the longitudinal direction.

7. The electrical connector according to claim 1, wherein the insertion slot has a slot bottom surface located at a back end thereof, the second main body has a base portion and a plurality of first portions formed by extending forward from the base portion, each of the first portions is provided with a corresponding one of the third wall surfaces and a corresponding one of the fourth wall surfaces, each of the signal accommodating slots accommodates a corresponding one of the first portions, and each of the first portions passes forward beyond the slot bottom surface.

8. The electrical connector according to claim 7, wherein each of the first portions has a first surface facing the insertion slot, and the first surface is provided to be recessed relative to a slot wall of the insertion slot.

9. The electrical connector according to claim 7, wherein each of the signal accommodating slots has two slot walls provided opposite to each other in the longitudinal direction, and a gap exists between each of the two slot walls of each signal accommodating slot and the corresponding first portion in the longitudinal direction.

10. The electrical connector according to claim 7, comprising a plurality of ground terminals, wherein the one of the two side walls is further provided with a plurality of ground accommodating slots arranged along the longitudinal direction, the ground accommodating slots are provided to be in communication with the insertion slot in the left-right direction, each of the ground accommodating slots accommodates one of the ground terminals, the ground terminals protrude into the insertion slot to be in contact with the mating member to form electrical connection therebetween, the ground accommodating slots and the signal accommodating slots on the same one of the two side walls are arranged in a row in the longitudinal direction, the second main body has a plurality of second portions located on the base portion, the second portions and the first portions are located on a same side of the second main body in the front-rear direction, and each of the second portions is completely located at an outer side of one end of a corresponding one of the ground accommodating slots away from the front end surface in the front-rear direction.

11. The electrical connector according to claim 10, wherein each of the two side walls is provided with a plurality of signal accommodating slots and a plurality of ground accommodating slots arranged in one row, the first main body has a partition extending from the slot bottom surface toward a direction away from the front end surface in the front-rear direction, the partition separates the two rows of the signal accommodating slots and the ground accommodating slots on the two side walls, and a gap exists between each of the first portions and the partition in the left-right direction.

12. The electrical connector according to claim 10, wherein each of the ground terminals has a fixing portion retained in the corresponding one of the ground accommodating slots, the one of the two side walls is provided with a plurality of notches corresponding to the fixing portions of the signal terminals and the fixing portions of the ground terminals, and each of the notches runs backward through the first main body a side of the one of the two side walls away from the insertion slot is covered by a metal member, the metal member is provided with a plurality of abutting arms corresponding to the ground terminals, and each of the abutting arms passes through a corresponding one of the notches and abuts the fixing portion of a corresponding one of the ground terminals.

13. The electrical connector according to claim 12, wherein the metal member shields the notches corresponding to the fixing portions of the signal terminals on the one of the two side walls.

14. An electrical connector, configured to be mated with a mating member, the electrical connector comprising:

a first main body, having a first wall surface, a second wall surface located at a front end of the first wall surface, and a front end surface located at a front end of the second wall surface;

a second main body, mounted on the first main body, wherein the first main body and the second main body are provided separately, the second main body has a third wall surface and a fourth wall surface located at a front end of the third wall surface, a first channel is formed between the first wall surface and the third wall surface, the first channel extends in a front-rear direction, a second channel is formed between the second wall surface and the fourth wall surface, and the second channel is provided obliquely forward and is in backward communication with the first channel; and a signal terminal, having a fixing portion and an elastic arm formed by extending obliquely forward from the fixing portion, wherein the fixing portion is accommodated in the first channel and fixed by at least one of the first main body and the second main body, the elastic arm is accommodated in the second channel, the elastic arm extends to form a contact portion, and the contact portion is exposed to the first main body in a left-right direction to be in contact with the mating member to form electrical connection therebetween;

wherein a width of the elastic arm in a longitudinal direction is greater than a width of the fourth wall surface in the longitudinal direction, and the longitudinal direction is perpendicular to the front-rear direction and the left-right direction respectively.

15. The electrical connector according to claim 14, wherein the second main body is mounted on the first main body forward from back thereof, and the second wall surface is at least partially located at a front end of the fourth wall surface.

16. The electrical connector according to claim 14, wherein the fixing portion is retained to the first main body, and the second main body abuts the fixing portion in the left-right direction.

17. An electrical connector, configured to be mated with a mating member, the electrical connector comprising:

a first main body, having a first wall surface, a second wall surface located at a front end of the first wall surface, and a front end surface located at a front end of the second wall surface;

a second main body, mounted on the first main body, wherein the first main body and the second main body are provided separately, the second main body has a third wall surface and a fourth wall surface located at a front end of the third wall surface, a first channel is formed between the first wall surface and the third wall surface, the first channel extends in a front-rear direction, a second channel is formed between the second wall surface and the fourth wall surface, and the second channel is provided obliquely forward and is in backward communication with the first channel; and a signal terminal, having a fixing portion and an elastic arm formed by extending obliquely forward from the fixing portion, wherein the fixing portion is accommodated in the first channel and fixed by at least one of the first main body and the second main body, the elastic arm is accommodated in the second channel, the elastic arm extends to form a contact portion, and the contact portion is exposed to the first main body in a left-right direction to be in contact with the mating member to form electrical connection therebetween;

wherein a width of the elastic arm in a longitudinal direction is greater than a width of the contact portion in the longitudinal direction, and the longitudinal direction is perpendicular to the front-rear direction and the left-right direction respectively.

18. The electrical connector according to claim 17, wherein the second main body is mounted on the first main body forward from back thereof.

19. The electrical connector according to claim 17, wherein the fixing portion is retained to the first main body, and the second main body abuts the fixing portion in the left-right direction.

20. The electrical connector according to claim 19, wherein a protruding rib is formed by protruding from the third wall surface toward the fixing portion, the protruding rib abuts the fixing portion in the left-right direction, a width of the protruding rib in a longitudinal direction is narrower than a width of the third wall surface in the longitudinal direction, and the longitudinal direction is perpendicular to the front-rear direction and the left-right direction respectively.

* * * * *